United States Patent [19]

Akagi

[11] Patent Number: 4,724,812

[45] Date of Patent: Feb. 16, 1988

[54] APPARATUS FOR CONTROLLING THE AIR-FUEL RATIO FOR AN INTERNAL COMBUSTION ENGINE

[75] Inventor: Motonobu Akagi, Anjo, Japan

[73] Assignee: Aisin Seiki Kabushiki Kaisha, Kariya, Japan

[21] Appl. No.: 28,575

[22] Filed: Mar. 20, 1987

Related U.S. Application Data

[63] Continuation-in-part of Ser. No. 781,723, Sep. 30, 1985, abandoned.

[30] Foreign Application Priority Data

Sep. 28, 1984 [JP] Japan ..... 59-204698

[51] Int. Cl.[4] ..... F02D 41/14

[52] U.S. Cl. ..... 123/435; 123/585

[58] Field of Search ..... 123/435, 585, 587, 588, 123/425, 438

[56] References Cited

U.S. PATENT DOCUMENTS

| | | | |
|---|---|---|---|
| 4,285,319 | 8/1981 | Hattori et al. | 123/585 |
| 4,377,140 | 3/1983 | Latsch | 123/425 |
| 4,462,368 | 7/1984 | Funada | 123/425 |
| 4,465,046 | 8/1984 | May | 123/435 |
| 4,489,596 | 12/1984 | Linder et al. | 73/116 |
| 4,535,740 | 8/1985 | Ma | 123/435 |
| 4,561,394 | 12/1985 | Kishida et al. | 123/587 |

*Primary Examiner*—Andrew M. Dolinar

*Attorney, Agent, or Firm*—Oblon, Fisher, Spivak, McClelland & Maier

[57] ABSTRACT

An apparatus for controlling the air-fuel ratio for an internal combustion engine and which includes a flame sensor provided in the vicinity of a spark plug within an engine combustion chamber, an air induction passage for bypassing a throttle valve of a carburetor, an electromagnetic valve disposed in the air induction passage to control an amount of air flowing through the air induction passage, and an electronic control unit actuating the electromagnetic valve by means of input electric signals from the flame sensor and including a control MAP based on a mutual relation between an air-fuel ratio and a time of firing.

5 Claims, 3 Drawing Figures

APPARATUS FOR CONTROLLING THE AIR-FUEL RATIO FOR AN INTERNAL COMBUSTION ENGINE

BACKGROUND OF THE INVENTION

This is a Continuation-In-Part Application of application Ser. No. 781,723 filed Sept. 30, 1985, now abandoned.

FIELD OF THE INVENTION

This invention relates to an apparatus for controlling the air-fuel ratio in general, and more particularly to an apparatus for controlling the air-fuel ratio for an internal combustion engine having a carburetor.

DISCUSSION OF THE BACKGROUND

In the internal combustion engine, it is necessary to maintain the air-fuel ratio of the air fuel mixture at a predetermined value of a theoretical air-fuel ratio in order to reduce exhaust emission pollutants from the engine and to improve fuel consumption. It is, however, difficult to constantly maintain the air-fuel ratio at a predetermined value by means of only the operation of the carburetor. It has, therefore, been proposed that a device for correcting the air-fuel ratio be added to the carburetor so as to control the air-fuel ratio to a predetermined value. For example, the apparatus disclosed in Japanese patent Laid-Open publication No. 79830 of 1976 includes an air induction bypass passage for bypassing a throttle valve of the carburetor, an electromagnetic valve provided in the air induction bypass passage, an oxygen concentration cell type sensor (a so-called $O_2$ sensor) provided in an exhaust pipe, and an electronic control unit receiving electrical signals from the $O_2$ sensor and actuating the electromagnetic valve, whereby the air-fuel ratio predetermined to be lean can approach the theoretical air-fuel ratio by means of controlling the degree of opening of the electromagnetic valve in response to the electrical signals from the $O_2$ sensor and by means of controlling the rate of air flowing through the air induction bypass passage.

In the above-mentioned prior art, however, the air-fuel ratio can be controlled by the $O_2$ sensor provided in the exhaust pipe. That is, the rate of air flowing through the air induction bypass passage is controlled in response to the electrical signals from the $O_2$ sensor provided in the exhaust pipe. In controlling the air-fuel ratio, therefore, a response time lag cannot be avoided. In order to correct the response time lag, it will be necessary to allow for a response lag in time for controlling the air-fuel ratio. It is, accordingly, difficult to optimally control the air-fuel ratio in response to engine driving conditions changing momentarily since the control accuracy will be reduced.

SUMMARY OF THE INVENTION

It is therefore an object of the present invention to eliminate the disadvantages of prior art apparatuses for controlling the air-fuel ratio.

Another object of the present invention is to provide an apparatus for controlling the air-fuel ratio wherein the response time lag can be substantially reduced.

Still another object of the present invention is to provide an apparatus for controlling the air-fuel ratio wherein the air-fuel ratio is controlled by means of a flame sensor provided in the vicinity of an ignition spark plug within a combustion chamber.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
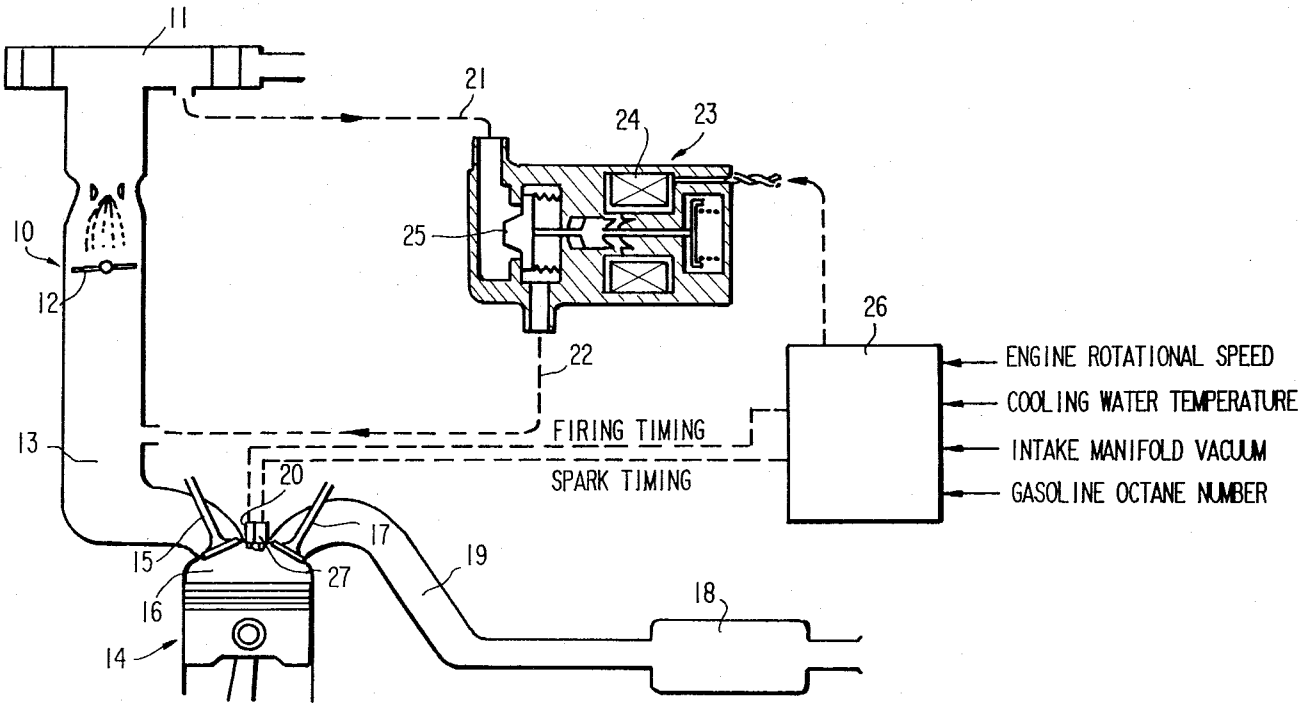
FIG. 1 schematically illustrates an apparatus for controlling the air-fuel ratio according to the present invention.

Referring now to FIG. 1, a carburetor 10 mixes air inducted from an air cleaner 11 and fuel inducted from a float chamber (not shown). An air fuel mixture with a substantially constant air-fuel ratio is supplied to an engine 14 through an intake manifold 13 in response to the degree of opening a throttle valve 12. That is, the air-fuel mixture is supplied to an engine combustion chamber 16 through an intake valve 15 and is discharged as an exhaust gas through an exhaust valve 17 to an exhaust purifying device 18 mounted in an exhaust manifold 19. Disposed in the engine combustion chamber 16 is a flame sensor 20 which includes electrodes, for example platinum wire electrodes, provided within the engine combustion chamber. Since the flame sensor 20 is positioned at a predetermined distance from a spark plug 27, an ion current generated by the flame can be detected by means of applying a predetermined voltage between the electrodes. Therefore, the time at which firing occurs can be detected by the action of the flame sensor 20.

An air induction bypass passage 21 bypassing the throttle valve 12 of the carburetor 10 directly connects the air cleaner 11 with the intake manifold 13 located downstream of the throttle valve 12. Disposed in the air induction bypass passages 21, 22 is linear type electromagnetic valve 23 which continuously controls the degree of opening of a valve member 25 by the energization action of a solenoid coil 24. That is, the electromagnetic valve 23 controls the amount of air flowing through the air induction bypass passages 21, 22 in response to an applied current, thereby controlling the air-fuel ratio. In this embodiment, the air-fuel ratio is controlled by the electromagnetic valve 23 which continuously controls the degree of opening of the valve member 25. It is, however, possible to incorporate an electromagnetic valve which controls the "on" and "off" operations thereof, instead of the above linear type electromagnetic valve 23 which includes an electromagnetically operable linear motor.

Figure 2:
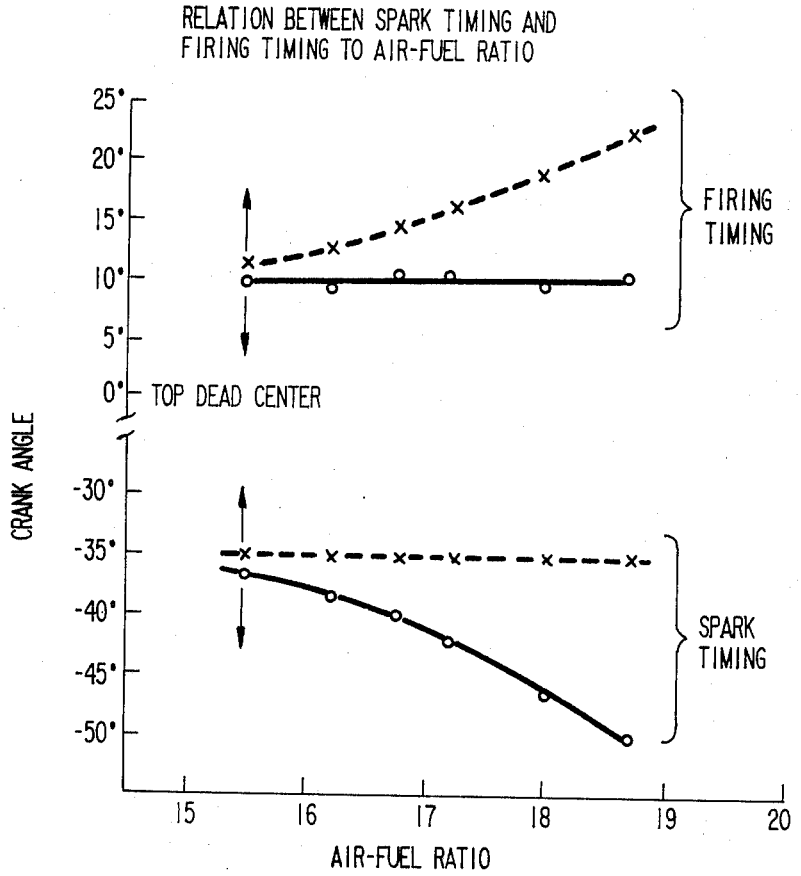
FIG. 2 is a graph showing the relation between spark timing and the time at which firing occurs with respect to the air-fuel ratio.

FIG. 2 is a graph showing the relation between spark timing and the time at which firing occurs with respect to the air-fuel ratio. If the spark timing is controlled as shown by the solid line in FIG. 2 with respect to the air-fuel ratio, the time at which firing occurs will be maintained substantially constant as shown by the solid line. To the contrary, if the spark timing is maintained constant as shown by the interrupted line in FIG. 2 to the air-fuel ratio, the time at which firing occurs will indicate a characteristic curve as shown by the interrupted line. Thus, there is a close relationship between the air-fuel ratio and the time at which the firing occurs, and it is therefore understood that the time at which firing occurs will be also maintained constant under the condition of the constant air-fuel ratio.

An electronic control unit (ECU) 26 includes a control MAP which is based on such mutual relation between the air-fuel ratio and the time of firing. The control MAP is corrected by engine rotational speed, cooling water temperature, intake manifold vacuum, and a gasoline octane rating or number so that the time of firing may move relatively up and down. The control unit 26 actuates the electromagnetic valve 23 by means of the control MAP in response to electrical input signals from the flame sensor 20, etc., thereby controlling the amount of air flowing into the intake manifold 13 through the air induction bypass passages 21, 22.

The MAP is utilized to control the amount of bypass air in the manner described below.

First, regarding the relation between spark timing and firing timing to air-fuel ratio, it is to be noted that with respect to change of air-fuel ratio, if the spark timing is controlled as shown in FIG. 2 under the same conditions (i.e., engine rpms, cooling water temperature, intake manifold vacuum, etc.), the firing timing is maintained constant. To the contrary, with regard to change of air-fuel ratio, if the spark timing is maintained constant under the same conditions, the firing timing changes as shown in FIG. 2. When the firing timing is detected, the air-fuel ratio can be detected at the real time under a predetermined spark timing.

With respect to control means for air-fuel ratio, it is to be noted that the structure of the apparatus for controlling the air-fuel ratio includes the electronic control unit (ECU) (26), electromagnetic valve 23, spark plug 27, and a coil and igniter (not shown). The sensors utilized include a crank angle sensor (not shown), a flame sensor, a vacuum sensor, a water temperature sensor, and engine revolution pick up, and a sensor for the gasoline octane number.

Figure 3:
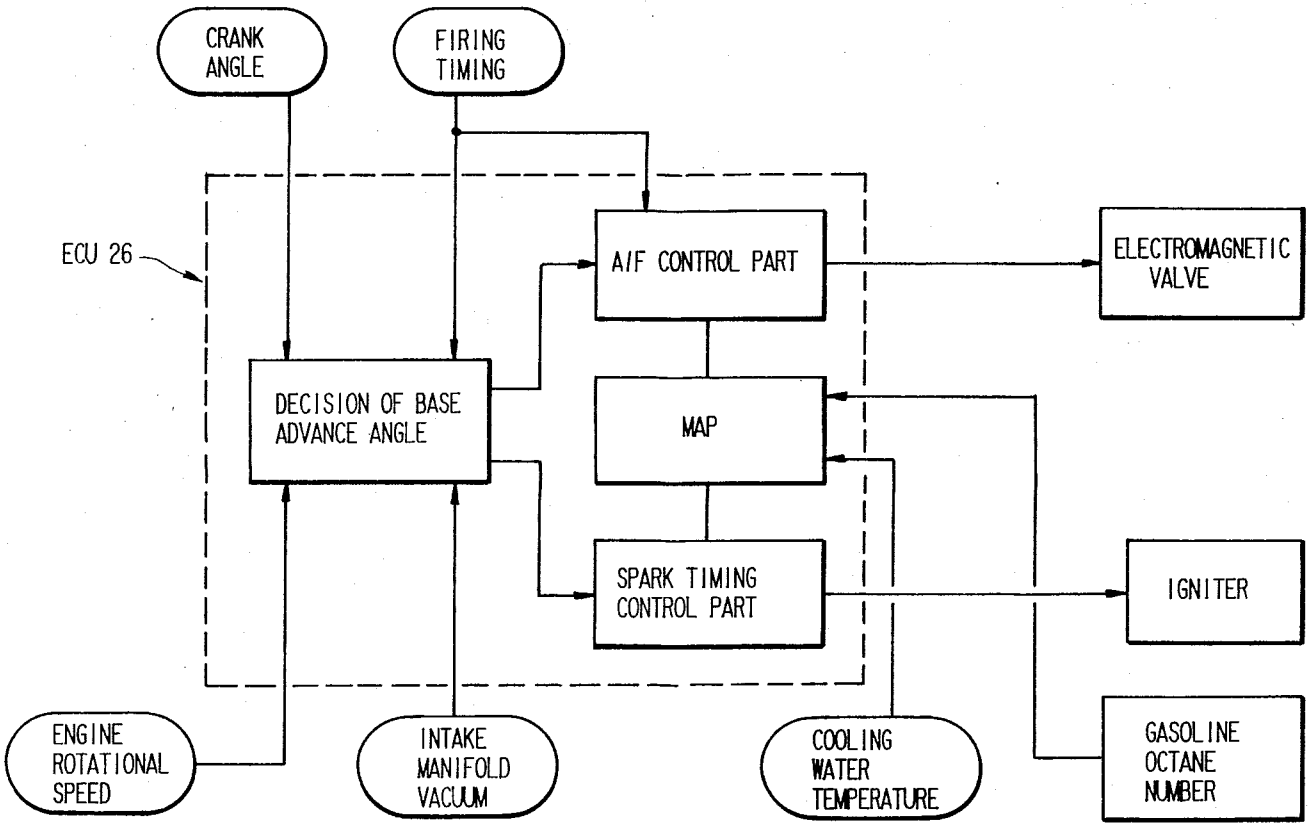
FIG. 3 is a block diagram of an ECU.

Regarding the control MAP of the ECU, as shown in FIG. 3, the ECU comprises a base map of three dimensions consisting of sparktiming, firing timing and air-fuel ratio. The base map can be divided based upon cooling water temperature and gasoline octane number or rating into the following four maps:

| | Cooling water temperature | gasoline octane number |
|---|---|---|
| MAP 1 | high temperature | high |
| MAP 2 | high temperature | low |
| MAP 3 | low temperature | high |
| MAP 4 | low temperature | low |

Operation of the apparatus for controlling the air-fuel ratio is as follows:

(i) The ECU detects the driving condition of the engine at real time by means of the flame sensor, the vacuum sensor, the water temperature sensor, the engine revolution pick up and/or the gasoline octane number. In addition, the ECU selects the control MAP (i.e., MAP 1-4) to control the air-fuel ratio.

(ii) Generally, if the engine rotational speed rises or if the engine load increases, the spark timing is advanced. If knock occurs, the spark timing is delayed to a limited extent. As mentioned above, the best control on the spark timing is obtained in the usual state so that high efficiency can be attained.

(ii) Consequently, the firing timing is changed. However, with regard to the base MAP, the ECU selects the control MAP which is changed by the parameter of the engine rpms and the intake manifold vacuum at the real time. In addition, the air-fuel ratio at the present time is judged by means of detecting the firing timing under a predetermined spark timing.

(iv) With regard to the target air-fuel ratio, for example, if the air-fuel ratio is moved to a lean side of the air-fuel ratio, the electromagnetic valve is controlled so as to be moved to a closed position. To the contrary, if the air-fuel ratio is moved to a rich side of the air-fuel ratio, the electromagnetic valve is controlled so as to be moved to an opened position.

(v) As a result, the air-fuel ratio can approach the targeted air-fuel ratio.

As mentioned above, the apparatus for controlling the air-fuel ratio of the present invention is capable of controlling the air-fuel ratio by use of only one sensor (i.e., the flame sensor), and also can control the spark timing and knock of the engine simultaneously. Therefore, the present invention is able to reduce the manufacturing cost and simplify the systems for air-fuel ratio control, spark timing control and knock control.

From the foregoing, it will be apparent that the air-fuel ratio can be controlled with accuracy and optimally by means of detecting the engine conditions through the flame sensor 20 positioned upstream of the exhaust manifold 19. As shown from the relative relation of the control MAP, it may be possible to control both the air-fuel ratio and the spark timing at the same time, whereby the engine control mechanism can be made simple and can be manufactured economically. Furthermore, since an engine abnormal combustion (so-called "knocking") can be detected, it may be possible to control knocking without a knock sensor which was required in the conventional engine control mechanism.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for controlling the air-fuel ratio for an internal combustion engine having a spark plug located therein and utilizing a carburetor with a throttle valve, comprising:

a flame sensor provided in the vicinity of said spark plug for detecting firing timing;

an air induction bypass for bypassing said throttle valve of said carburetor;

electromagnetic valve means disposed in said air induction bypass passage for controlling an amount of air flowing through said air induction bypass passage; and electronic control device means in communication with said electromagnetic valve for actuating said electromagnetic valve by means of input electric signals from said flame sensor, wherein said electronic control device means further comprises a control MAP based on a mutual relation between an air-fuel ratio, spark timing and firing timing, said electronic control device means controlling via said control MAP a degree of opening of said electromagnetic valve means under a condition of a controlled spark timing so that a desired air-fuel ratio is maintained.

2. An apparatus for controlling the air-fuel ratio for an internal combustion engine as set forth in claim 1 wherein said flame sensor further comprises a plurality of platinum wires.

3. An apparatus for controlling the air-fuel ratio for an internal combustion engine as set forth in claim 1 wherein said control MAP is corrected by engine driving conditions.

4. An apparatus for controlling the air-fuel ratio for an internal combustion engine as set forth in claim 3 wherein said engine driving conditions further comprise engine rotational speed, cooling water temperature, intake manifold vacuum, and gasoline octane rating.

5. An apparatus for controlling the air-fuel ratio for an internal combustion engine as set forth in claim 1 wherein said electromagnetic valve further comprises an electromagnetically operable linear motor.

* * * * *

UNITED STATES PATENT AND TRADEMARK OFFICE

CERTIFICATE OF CORRECTION

PATENT NO. : 4,724,812

DATED : 02/16/88

INVENTOR(S) : Motonobu AKAGI

It is certified that error appears in the above-identified patent and that said Letters Patent is hereby corrected as shown below:

At Column 4, line 3, change "(ii)" to --(iii)--;

and at line 57, after "bypass" insert --passage--.

Signed and Sealed this

Twenty-second Day of November, 1988

*Attest:*

DONALD J. QUIGG

*Attesting Officer*

*Commissioner of Patents and Trademarks*